US007493844B2

(12) United States Patent
Martin

(10) Patent No.: US 7,493,844 B2
(45) Date of Patent: Feb. 24, 2009

(54) VEHICLE SECURITY PARTITION

(76) Inventor: Chad Brian Martin, 1999 Paxton Rd., Morning View, KY (US) 41063

( * ) Notice: Subject to any disclaimer, the term of this patent is extended or adjusted under 35 U.S.C. 154(b) by 0 days.

(21) Appl. No.: 11/494,339

(22) Filed: Jul. 27, 2006

(65) Prior Publication Data

US 2008/0190278 A1 Aug. 14, 2008

(51) Int. Cl.
*F41H 5/08* (2006.01)

(52) U.S. Cl. ..... 89/36.07; 89/36.08; 89/36.09; 89/36.01

(58) Field of Classification Search ..... 89/36.01, 89/36.07, 36.08, 36.09, 36.05, 36.06
See application file for complete search history.

(56) References Cited

U.S. PATENT DOCUMENTS

| | | | | |
|---|---|---|---|---|
| 3,510,164 | A * | 5/1970 | Setina | 296/24.46 |
| 3,666,313 | A * | 5/1972 | Halstead et al. | 296/24.46 |
| 3,848,547 | A * | 11/1974 | Schaefer | 109/49.5 |
| 4,412,495 | A * | 11/1983 | Sankar | 109/49.5 |
| 4,908,083 | A * | 3/1990 | Hall | 156/99 |
| 4,964,666 | A * | 10/1990 | Dillon | 296/24.46 |
| 5,377,577 | A * | 1/1995 | Bounkong et al. | 89/36.05 |
| 5,619,007 | A * | 4/1997 | Mena et al. | 89/36.09 |
| 5,811,719 | A * | 9/1998 | Madden, Jr. | 89/36.08 |
| 6,250,700 | B1 * | 6/2001 | Traxler | 296/24.46 |
| 6,286,882 | B1 * | 9/2001 | Rastetter | 296/24.41 |
| 6,691,601 | B2 * | 2/2004 | Cohen et al. | 89/36.05 |
| 6,990,887 | B1 * | 1/2006 | O'Donnell | 89/36.07 |
| 7,124,675 | B1 * | 10/2006 | Sand | 89/36.07 |
| 7,302,880 | B1 * | 12/2007 | Elasic | 89/36.07 |
| 2003/0221547 | A1 * | 12/2003 | Peretz | 89/36.02 |
| 2005/0062304 | A1 * | 3/2005 | Murray et al. | 296/24.42 |
| 2006/0243126 | A1 * | 11/2006 | Tyler | 89/36.01 |

* cited by examiner

*Primary Examiner*—Michael J. Carone
*Assistant Examiner*—Stewart T Knox

(57) ABSTRACT

Disclosed is an integrated vehicle and personal ballistic protection system providing a combination of space utilization, portability and increased personal safety. Also disclosed are kits for up-fitting the shield to an existing installed partition, and a kit for the trunk. The embodiment s depicted and suggested include a vehicle partition integrated with a hand-carry, quickly deployable, self-supporting, ballistic shield including a handle, and shaped to cooperate with a vehicle security partition and is part of the partition when temporarily stowed. An additional optional design feature of the shield is a shape that cooperates with removable mounting hardware for stowing on the underside of the trunk lid, under the rear deck, or on the trunk floor. A benefit of unitary construction, is that governmental safety forces can issue the same shield for cruisers and unmarked detective vehicles.

5 Claims, 5 Drawing Sheets

VEHICLE SECURITY PARTITION

FIELD OF THE INVENTION

The present invention pertains generally to vehicular interior security partitions and ballistic shields.

BACKGROUND OF THE INVENTION

Interior vehicle security partitions are widely used by law enforcement for up-fitting cruisers. Some partitions include a frame and provide a barrier in the upper portion constructed out of mesh wire, thin impact-resistant plastic sheet, or other tamper-proof material which does not impede the rear vision of the driver. The typical single-sheet acrylic or polycarbonate sheets may consist of two overlapping sheets that slide laterally within a track. Additional lateral and lower panels are typically provided around the frame to prevent intrusion by the hands and feet from the rear seat compartment.

An exemplary conventional vehicle security partition is shown in U.S. Pat. No. 6,827,382 Assigned to Pro-Gard Industries, L.P., Indianapolis Ind. which illustrates a partition including a guard panel attached to a tubular steel frame which is mounted between the vehicle B-pillars. The panel within the perimeter of the frame can be made from thin, rigid sheet of cold rolled steel which is spot welded to the frame including a void portion to allow observation without compromising security. The upper portion of the frame houses a single transparent impact resistant sheet of polycarbonate or acrylic (PMMA) thermoplastic material. The window is illustratively supported within the front panel by conventional fasteners, such as bolts. Alternatively, the window may comprise any number of widely available stamped metal sheets and wire screens having a mesh size so as to limit finger access to the front occupant area.

U.S. Pat. No. 4,964,666 to Dillon, assigned to Automotive Prototypes & Equipment, Ann Arbor, Mich. discloses a mounting system for a vehicle partition including a body, a pair of legs mounted on either side of the body disposed over a corresponding lateral frame member of the vehicle and an adjustment screw disposed in each leg for raising the shield body from the lateral frame member toward the roof of the vehicle. The partition window is described as either a solid sheet of transparent polycarbonate of sufficient thickness to prevent damage from the rear seat or a wire mesh with holes small enough to prevent finger access. Neither of these constructions contemplates ballistics nor detachable components for portability.

Personal ballistic armor shields are known. U.S. Pat. No. 4,412,495 to Sankar illustrates a total body protective device including a pair of fabric panels made of bullet-proof material, handles on an upper of the panel pieces for holding the device, and a window through the top panel piece for observing an assailant, and means to roll up or fold the device when not in use. This device is not designed to be self-supporting.

U.S. Pat. No. 5,811,719 issued to Madden, Jr. discloses a bullet-resistant partition for attaching to a vehicle which includes a flexible curtain secured to a door of the vehicle. The flexible curtain is secured to a frame below a window in the door. The curtain is bullet resistant. The curtain may be easily installed and removed from the door. The curtain is made of layers of fibrous material, such as woven cloth, preferably of an aramid fiber, such as a KEVLAR® cloth, or "SPECTRA SHIELD®" material. A bullet-resistant upper flap of the same material as the curtain pivots on the curtain.

The entire apparatus can be removed for transferring to another vehicle, but is not designed for rapid engagement/disengagement.

U.S. Pat. No. 6,286,882 discloses a vehicle interior partition that is divided into at least two partial units that abut one another in a transverse direction of the vehicle. One partial unit of the partition is immovably mounted behind a driver's side of the front area. At least one additional partial unit is movable between two end positions, with the end positions opening or closing a passageway area between the front area and the rear area.

U.S. Pat. No. 5,271,311 discloses a bullet resistant apparatus for the sides of a vehicle and bullet resistant partition apparatus for use behind the front seat of a vehicle. Both types of apparatus utilize transparent panels and flexible curtain elements, each secured to the vehicle, with the flexible curtain element extending below the transparent panels. The apparatus may be readily installed from one vehicle to the next.

Patrol officers are often the first to arrive on the scene involving hostile acts or threats and potential gunfire. An officer may then call for back-up, and this may include a request to bring in a well-equipped strategic weapons and tactical team (SWAT). Equipment issued to these teams and stored in large vans includes armor shields, usually mounted on wheels and suitable for advancing on a perpetrator and/or rescue victims from the line of fire of the perpetrator. The first officer arriving in a patrol car however may only have a ballistic vest. SWAT-issue armor will not fit within the limited trunk space of the patrol car, or will interfere with other stowed equipment. Many of the rigid ballistic shields in use today are too heavy, bulky and expensive to issue to the thousands of patrol officers who are likely to be first on the scene. Moreover in many traffic stop incidents, officers can instantly come under direct fire at close proximities when suspects are about to be apprehended. Despite the cost and bulky size of SWAT-type ballistic shields in use today there is an urgent need for practical and economic advancement to protect personnel such as law enforcement who are often the first to arrive at hostile situations involving guns.

An unmet need therefore exists for a portable ballistic shield that can be quickly deployed from a law enforcement vehicle and that takes up a minimum of space when stowed in the vehicle. A portable ballistic shield that is available immediately by disengagement from the vehicle, and of lightweight construction would provide a solution to this unmet need.

SUMMARY OF THE INVENTION

The invention in one aspect provides an integrated vehicle and personal ballistic protection system providing a combination of space utilization, portability and increased personal safety. The first embodiment is a vehicle partition integrated with a hand-carry, quickly deployable, self-supporting, ballistic shield including a handle, and shaped to cooperate with a vehicle security partition and is part of the partition when temporarily stowed. An additional optional design feature of the shield is a shape that cooperates with removable mounting hardware for stowing on the underside of the trunk lid, the benefit being that governmental safety forces can utilize the same issued shield for cruisers and unmarked detective vehicles.

Another aspect of the invention pertains to additional parts making up a up-fitting kit for modifying a vehicle partition. An additional aspect includes parts for up-fitting a trunk lid. These kits provide quick-release, engagement/disengagement mechanisms.

Another object of the invention is to provide a hand-carry ballistic shield mount apparatus for removably stowing the hand-carry shield in the trunk, and including a trunk compartment stowage kit comprising a ballistic shield containing engagement/disengagement mechanism components cooperative with shield-receiving hardware attached to the trunk floor, the underside of the trunk deck, or the underside of the trunk lid.

DETAILED DESCRIPTION

Figure 1:
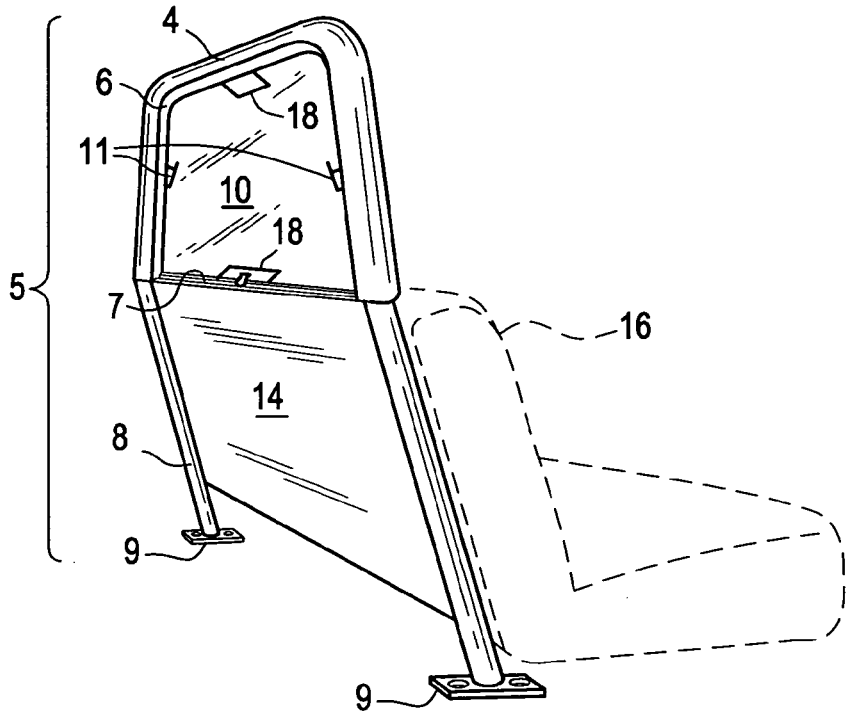
FIG. 1 is an oblique view of a vehicle interior partition with the outline of a front seat, the partition is outfitted in the upper portion of the frame with a removable, self supporting ballistic shield of the present invention illustrating the dual function of the single shield as a self-supporting partition barrier and usable portable personal shield, with no additional space utilization over conventional partitions.

For orienting space, direction and dimension, forward means toward the front of a vehicle; upper means the open space above the front seatback and below the vehicle roof; driver side means the side where the steering wheel is; passenger side means the side opposite the driver side. Reference to left means when facing the front of the vehicle. In North American vehicles, the steering wheel is on the left side of the vehicle compartment. Reference to the vertical plane is the plane perpendicular to the general plane of the roof. The partition frame is generally vertically oriented, or tilted several degrees from vertical typically when the front seatback is tilted. Reference to the long axis means lengthwise in the dimension that is longer than any other overall dimension. The preferred shield is generally rectangular, but can be any shape. The shield overall shape is a function of the space designed in the vehicle partition, and the overall dimension of the plane bounded by the underside frame members making up the trunk lid. In the context of a vertical partition, the long axis of the shield is oriented horizontally, parallel to the roof and floor pan. Reference to perimeter means the outer perimeter of the shield. Reference to shield frame means a supporting frame engaging the perimeter portion of the shield panel. The shield frame is needed to aid in self-support feature, provides rigidity for secure engagement/disengagement mechanism for removable mounting of the shield to the partition, and support against the tendency to sag when stored horizontally in the trunk.

The assembly of the vehicle interior partition comprises a partition functioning to separate the front seat compartment from the rest of the interior vehicle compartment and removable, hand-carry ballistic shield and mounted thereon at least one grasping member, e.g. a handle and the cooperating engagement/disengagement components. The partition has an upper portion- and a lower portion and framing members, and a plurality of vehicle-to-partition attachment members located at points along the framing members. The partition includes a shield engagement/disengagement mechanism (component of) for removably securing the portable hand-carry, ballistic shield. The shield when secured to the framing members provides a tamper-resistant barrier portion of the partition to protect a front seat occupant. The ballistic shield contains a ballistic panel made of an assembly of at least a first and a second penetration-resistant layer. The assembly of penetration-resistant layers is engineered to provide a predetermined level of ballistic performance taking into account the desired portability and weight. The shield contains a perimeter frame to house the multiple-layered panel(s), and at least one handle to allow said shield to be held when carried away from the vehicle for use as a ballistic shield.

Another aspect the invention relates to a hand-carry, polymer-based, bullet-resisting shield assembled from panels made from materials selected from transparent films, for example polycarbonate, and woven ballistic fiber panels containing fibers, for example known materials such as HMWPE and/or aramid fibers. The shield embodiment can be transparent over the entire square area, opaque over the entire square area, or it can contain a transparent portion and an opaque portion, depending on the desired panel design. A transparent portion provides a see-through feature for a shield engaged to the upper portion of the vehicle interior partition. The shield is designed of an outer shape and dimension to fit within or be congruous with selected partition frame members. The shield as mounted to the partition functions as a partition, and is able to be rapidly deployed as a hand-carried shield to protect the user from gunfire and enable the user to interdict a hostile situation.

The hand-carry portable bullet-resisting shield includes at least one grasping element, most commonly suitable is a handle for fingers to grasp. The handle may be provided as an integral component of the shield engagement/disengagement mechanism, or on the shield frame. An example detachment mechanism comprises two engaging components such as a latch and latch receptacle. In one embodiment the latch receptacle is mounted on the shield and engages with a complimenting latching member mounted on the partition. Preferably there are at least two engagement/disengagement mechanisms provided along the perimeter of the shield.

The shield according to the general aspects of the invention can alternatively be removably secured to the vehicle within the trunk compartment. The detachment mechanisms used in the partition are advantageously designed also be mounted in the trunk, on the underside of the trunk lid, on the floor, or behind the front bench seat.

In another aspect the invention pertains to a shield/partition system comprising an interior vehicle partition that removably secures a ballistic shield, wherein the components of the engagement/disengagement mechanism on the partition frame are adaptable to be installed on the underside of the trunk lid, thereby providing two locations for stowing the ballistic shield.

The ballistic shield-vehicle partition assembly of the invention includes partition frame members secured to the interior vehicle compartment and providing framing which is congruous with the ballistic shield perimeter, and engagement/disengagement mechanism for removable mounting the hand-carry, ballistic shield. The shield is shaped and sized to fit within a designed partition frame aperture in the general plane of the frame members. Alternatively, the shield can be of a shape for mounting along side the frame members in an adjacent plane, either on the forward or rearward face of the partition frame. Various types of engagement/disengagement mechanisms are contemplated, including any combination of components selected from a U-channel, angle members, latch, pins, slots, cam levers, and the like. The partition embodiment provides a robust barrier from the ballistic shield and occupies little or no additional interior space in the vehicle over that taken up by conventional security partitions. The preferred shield embodiment is transparent and includes at least one handle and quick-release mechanisms and mounted in an aperture formed in the upper portion of the partition frame members spanning from the underside of the vehicle roof to around the top surface of the front seat, and extends practically the entire distance laterally between the driver and passenger doors (at the B-pillars). The perimeter of the shield preferably defines a round-edged rectangle designed to fill the space designed in the partition frame members. The preferred latch mechanism disengages the shield from the vehicle partition toward the rear, allowing the driver to exit the vehicle, retreat to the rear seat area, disengage the shield and advance toward a hostile from behind the opened front door.

In one embodiment of the invention, an up-fitting kit is provided for installation of engagement/disengagement mechanism for converting a vehicle already equipped with a conventional partition to receive the ballistic shield. In the preferred up-fitting kit, components modify the partition by providing spacer members, e.g. corner inserts, channeling, and the like, and a bendable perimeter bead fastenable to the modified opening of the partition frame. The up-fitting kit includes shield retainer members securable to the partition frame members, an optional shield-receiving channel, or retainer members, and shield engaging/disengaging hardware. Optionally, the kit includes a pre-assembled shield sub-frame in one piece that is bolted, riveted, or welded to the partition frame members. The pre-assemble sub-frame contains shield retainer members, and latch hardware and this subassembly can be installed on the partition with a minimum of labor. The engagement/disengagement mechanism provides a quick-release/install for the ballistic shield which does not require significant added weight to the shield.

The preferred shield and partition embodiment includes a latch assembly containing the grasping or moving part such as a pin retainer or cam, mounted on the partition and cooperating pin or slot bracket mounted to the shield. When the shield is removed from the partition, an optional security wire mesh screen, permanently fixed to the partition can be included.

One embodiment engagement/disengagement mechanism is quick-release system comprising a channel running along a horizontal section of the partition frame member, and two spaced-apart latch mechanisms. The shield contains corresponding spaced-apart latch receptacles. On installing the shield upright in the upper aperture of the partition frame, the shield edge opposite the latch receptacles is inserted into the channel and the opposite edge of the shield is brought into proximity with the partition frame to engage the receptacles with the latches. This embodiment comprises a shield holding channel and at least one latch mechanism. The upper portion of the partition type disclosed in U.S. Pat. No. 6,827,382, for example, can be modified to provide an upper mesh screen. When releasing the latch, a shield handle is grasped, and the shield is slid sideways, or lifted out of the retaining channel depending on the location of the channel(s). Alternatively the shield is removably secured to a partition frame by a combination of latches absent a retaining channel on the partition.

In another aspect there is provided a vehicle interior partition including:

(a) a partition frame comprising at least one vehicle attachment member, a shield aperture, at least one shield receiving member and at least one shield fastening member;

(b) a portable, hand-carry, bullet-resisting personal shield comprising multiple layers of penetration-resistant plastic, an edge, at least one protrusion for grasping by the hand, and at least one partition frame engagement member, wherein the shield receiving member and frame engagement member cooperate to provide a quick release system for rapid removal of the shield from the partition frame.

In one embodiment, the apparatus is constructed of metal frame members that run along the roof, B-pillars, seat, and extend to the floor of the vehicle. There is a open area at the upper section of the partition, at least a portion of the open area is defied by the partition frame. The partition frame can completely surround the open area, or can partially surround the open area. The open area can be bounded on the sides by upward posts, and along the bottom of the open area by a cross-member of the partition with no frame member running along the roof, for example. The design of the ballistic shield, and its frame provides alternatives to reduce the materials required for the partition frame, and is a routine design selection.

The vehicle interior partition preferably contains an outer frame for attachment to the vehicle and latches or latch receptacles facing forward and/or inward, depending on the desired design of the shield quick-release system. The partition frame thus supports the shield and fortifies at least the outer perimeter of the partition. When the portable shield is secured to the partition, the shield functions as part of the barrier to isolate and protect the front seat occupants from rear seat occupants who are usually the detained perpetrators or prisoners. It should be noted that the latching mechanism to provide quick release of the shield is operable only by a person from the front side of the partition, that is, from the front seat compartment of the vehicle.

One embodiment partition includes a framed screen constructed of wire mesh in at least the upper portion of the partition, and a frame to support and/or removably secure the shield at the latches (latches, fasteners are used interchangeably). The lower portion of the embodiment partition includes uprights, or legs below the frame. The embodiment frame is secured to the vehicle structural members and its legs at several points, such as the roof, driver side B-pillar and passenger side B-pillar and each leg is secured to the floor. The portion of the partition frame above the seatback defines an inner aperture frame having an interior edge defining the perimeter of the aperture that is similar or the same as the shield.

Another partition embodiment has a rectangular, floor-to-ceiling perimeter frame with brackets in place of relatively longer legs. The brackets face away from the inner aperture to couple to mountings on the vehicle body members (e.g. roof, floor and B-pillars). The brackets and mountings are aligned to engage one another by through pins, rivets, bolts, and/or welding. Brackets are advantageously located near corners of the frame which face the roof and sides, such as at both B-pillars.

Illustratively, clamping members of the first and second pillar couplers each include a body portion having inwardly facing locking lips. The locking lips of the front and rear clamping members cooperate to secure the pillar coupler from movement relative to one of the passenger side pillar and driver side pillar.

One partition embodiment includes a perimeter frame with a mid-horizontal sub frame member located at a height corresponding to the top of the front seat back. The aperture housing the portable personal shield is defined by the upper horizontal frame member nearest the roof, the side frames at each B-pillar and the mid-horizontal sub frame member. With shields of a predetermined size which is less than the square area of the largest aperture, there can be one or two vertical sub frame members spaced apart to provide a smaller aperture for the shield. Preferably the aperture area outside of the frame which houses the shield is filled in with a wire mesh or clear plastic barrier material.

In one embodiment the Shield installs within the plane of the aperture and fits snugly within the aperture frame. In another embodiment, the Shield butts against the front face of the aperture frame. The frame can be fabricated from metal angle, channel, tubing stock, or in structural plastics, such as thermoset fiber reinforced members of these sorts of shapes. The frame can be preassembled in one or more sections, and dimensioned to be securely fastened to the vehicle structural members as the B-pillars, floor and/or roof. The frame is preferably fastened at least at four points. The frame is installed in the vehicle interior behind the front seats and is secured to roof, B-pillar and/or floor by straps and screws, or with brackets and bolts, by welding, eyelets and screws, and the like. The upper portion of the frame above the top of the seatback includes an aperture frame for accepting engagement with the Shield. The aperture frame is a frame within a frame.

The outline of the perimeter edges of the Shield generally define a rectangular, with generally opposing upper and lower edges being longer than the opposing side edges. The long axis of the Shield is horizontal when the Shield is fastened and in proper alignment in the frame aperture, the upper long edge is nearest the vehicle roof, the lower edge is nearest the vehicle floor, the left edge is closest the driver's side of the vehicle and the right edge is nearest the passenger side of the vehicle. The Shield is sized to either to fit entirely within the plane defined by the aperture and span a major proportion or all of the open area of the aperture, between the B-pillars, roof and floor. Depending on the seat positioning, angle of the seatback and position of the B pillars in each vehicle model, the Shield will lie in the vertical plane above the front seatback or immediately behind the front seatback. The corners of the CBRP are preferably radiused (rounded) according to design choice, interior vehicle space and taking into account pre-selecting an overall size dimension which optimizes the universal fit for a number of shape(s) to fit many vehicle models.

Materials of construction for the bullet resistant shield member are known in the art. Many different types of polycarbonate sheeting are usable as a bullet proof material. One form of polycarbonate sheet containing bullet proof material is described in Hall, U.S. Pat. No. 4,908,083, which discloses an impact-resistant laminate comprising polycarbonate up to 3 mm thick, adhered to glass.

U.S. Pat. No. Re. 32,406, discloses a polycarbonate sheet coated with a polyurethane sheet. U.S. Pat. No. 4,387,129, discloses a polyurethane adhesive material for making laminates, and specifically, one embodiment in which a laminate comprising a 1.5 mm thickness of polyurethane resin adhesive to bond two layers of 10 mm polycarbonate and another embodiment in which a 4 mm sheet is disclosed. A bullet-resistant material marketed under the Victoreen® mark is a clear PH lead plastic (12 mm lead equivalent); a transparent laminate material marketed under the "LEXGARD" trademark of General Electric Company; a laminate of glass and polycarbonate bonded together by polyurethane adhesive. A specific LEXGARD embodiment is MP-750 has a total thickness of 0.775 inches and is made of 3-plies of polycarbonate laminated together and which weighs 5.1 pounds per square foot. Lexgard® sheets pass Underwriters Laboratories (UL) Level 1 (9 mm) bullet resistance.

Another embodiment shield can be constructed of two polycarbonate layers bonded by a polyurethane layer, or polyvinylbutyral adhesive layer as shown in FR-A1-2 612 174. The overall thickness of the shield panel will vary in accordance with a pre-determined level of bullet resistance and eight per area desired.

Numerous ballistic resistant materials are available from different manufactures which may find application in forming the ballistic panels of the shield deployed in the present invention. Such materials may include woven and non-woven fabric comprising fibers of very high molecular weight polymers, suitably polyolefins, such as polyethylene or high molecular weight polypropylene, PBO resins and/or aramid polymers. These fabrics are sold commercially under such names as "Spectra", "Protera", "Kevlar", "Zylon", "Gold Shield", "TWARON" and "Dyneema". A more detailed listing of suitable ballistic resistant materials is set forth in U.S. Pat. No. 6,127,291, which is incorporated herein by reference in its entirety. Still further, while 13 layers have been shown in one aspect of the present invention illustrated in FIG. 1, it is contemplated that more or less layers in different combinations may be utilized without deviating from the present invention.

One of the hand-carry shield embodiments can be constructed using multiple layers of ballistic woven fabrics. There are many known patterns of layering whereby penetration-resistant woven fiber sheets are bonded together using a scrim or fusable polymer binder material. Different ballistic fabrics may be used, e.g., in alternating patterns. Preferably there are included fabric plies each formed of woven KEVLAR 29 brand fiber from Du Pont de Nemours. Spectra Shield LCR brand non-woven or woven materials can also be used. An example KEVLAR fabric is understood to be Style 713, plain weave, 8.3 oz/square yard, 31×31 thread count. An exemplary Spectra Shield LCR embodiment includes a unidirectional polyethylene fiber of approximately 0.007.+−.0.002 inch diameter with an area density of 4.42.+−.0.29 oz/square yard. The Spectra Shield LCR layers may have a fiber orientation of 0°×90°. Alternatively, the Spectra Shield LCR layers may have fiber orientations of 90°×90° and 45°×45°.

Suitable alternative materials may include, but are not limited to, Kevlar Style 710, plain weave 9.4 oz/square yard with a 24×24 thread count; Style 729, plain weave, 6.5 oz/square yard, 17×17 thread count; and Style 745, plain weave 13.6 oz/square yard, 17×17 thread count. Ideally, the shield 10 is constructed of multiple layers of Kevlar fabric. The fabric warp is placed in specific directions for each layer, which is known as the lay-up schedule. The lay-up schedule is an engineered arrangement to provide ballistic capturing strength. In accordance with this schedule. One lay-up schedule requires each layer to have its warp positioned 45 degrees from the previous layer. Thermoplastic thin sheets may be placed between each layer of fabric. The total number of layers determines the ballistic capture strength of each panel. Once the lay-up schedule is completed the assembly is placed in an autoclave, this condenses the assembly of materials and sets the thermoplastic to shape.

Another embodiment shield which is self-supporting is a combination of a portion of the total panel area being multiple layered panel of transparent sheets (e.g. polycarbonate) and a portion of the total area being constructed of woven ballistic fiber (e.g., Kevlar®, or Spectrshield® fibers), and made unitary by a shield frame which surrounds the perimeter and holds the two panels in butted relationship. A shield thus can be made of a combination of transparent bulletproof material in pre-selected areas of the face of the shield and areas made with fabric material, such as aramid fibers, e.g., woven, composited Kevlar® fiber, and providing a self-supporting strength by a frame, made from metal or rigid plastic. A glass or carbon fiber reinforced plastic molded from long fiber pellets is a suitable material for forming the frame.

With reference to the Figures, wherein like numerals depict similar structures, FIG. 1 illustrates a tubular steel partition 5, with frame 4, legs 8, base plates 9, kick plate 14. The partition is mounted behind the front seat 16. Base plates depicted in this embodiment as flanges 9 with bore holes for bolts, screws, pins or rivets (not shown). The upper portion of the frame at 4 includes bent tubular roll bar type member forming a surrounding opening (aperture) within which is provided the removable ballistic shield 10. A shield-retaining ledge (not shown) is fixed to the inner side of the frame and forward of the shield so that the shield is removable only rearward. Engagement/disengagement hardware (e.g. lever/pin clasping latches) 11 allows quick release of the shield to the rear compartment of the vehicle, and is a preferred feature. Shield 10 embodiment can be seen through, and contains multiple layers of penetration-resistant plastics. Held together by a shield rim (shield frame) 6. Increased rigidity for positioning the shield in the partition aperture can be provided by an optional lower channel 7 which receives the lower horizontal edge of the shield. This channel, if used, is preferably lined with a soft plastic, e.g. TPE, so that when the latches are released the lower edge of the shield can be lifted out of the channel after pivoting the shield forward slightly to clear the upper frame member 4.

Figure 2:
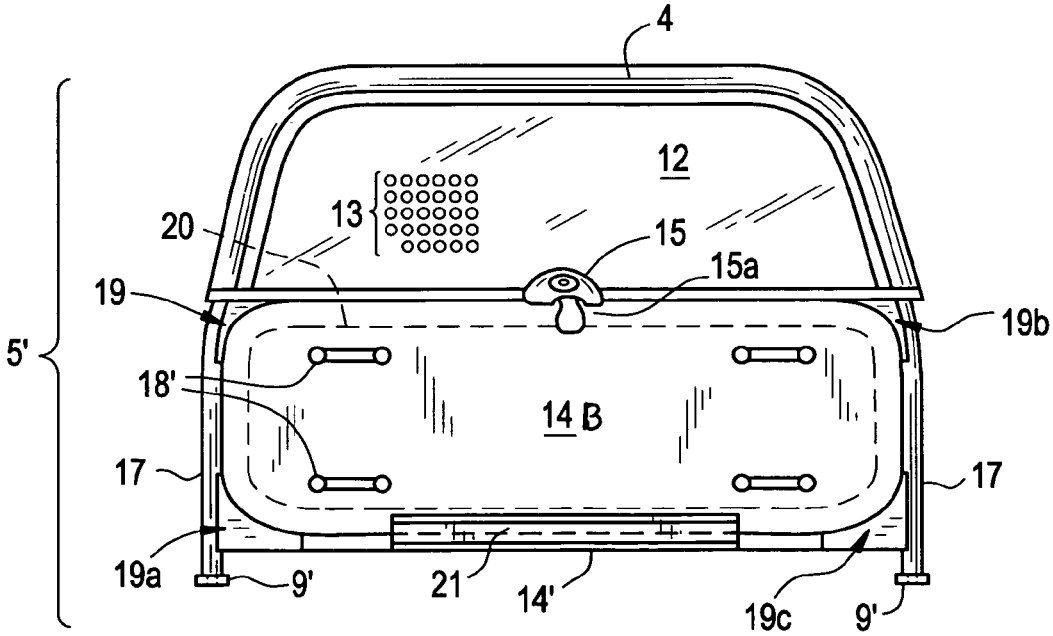
FIG. 2 is a rear plan view of a vehicle interior partition according to the invention illustrating a removable, self-supporting, frame enclosed woven fiber ballistic panel of multiple layers (layers not shown) installed removably at the lower portion of the partition between the partition legs.

FIG. 2 depicts a partition assembly 5' with installed ballistic shield 14 B. The partition frame is constructed of tubular steel, with upper frame member at 4, lower legs 17, mounting flanges at 9', shield retaining inner shelf 20 located forward of the shield, frame corner inserts 19, 19-*a*, 19-*b* and 19-*c*, and channel 21 integral with the kick panel lower edge at 14'. Channel 21 accepts the lower horizontal edge of the shield, and is preferably lined with a plastic, or rubber lining (not shown). Partition corner inserts 19-19-*c* provide a matching curved surface congruent with the shield edges, and can be fabricated using bent steel sheets, or molded from rigid thermoplastic. FIG. 2 depicts a transparent upper pane of plastic having an array of holes drilled near the point near the driver's head to facilitate speaking. Shield 14 B is removably locked to the partition frame by a keyed, rotating retainer 15 which has a keyed cylinder locking mechanism. Retainer 15 is unlocked and rotates retainer tongue 15-*a*, to allow the shield to clear the tongue for disengagement of the shield from the partition.

FIG. 2 depicts a shield installed within an aperture frame located in the lower portion of the partition. An optional feature for the shield (not shown) provides an opening (void) in the shield panel of a size for allowing a handgun barrel to be protruded, and facilitates listening and talking to rear seat passengers when installed with the partition. The shield handles 18 could also be knobs, a fastened strap, or rigid handle of desired shape and contour. The handle(s) protrude(s) from the side of the shield that is grasped to remove the shield, and either in the forward face when disengaging the shield forward direction or on the rear face for shield embodiments which are removed from the partition from the rear compartment. The handle may provide more than one grasping means such as one or two handles and/or handle and strap. Another example includes a strap to allow the user's forearm to pass through and a handle for grasping to allow the user to run holding the shield with one arm/hand and a gun in the other hand. It is an important feature to provide a handle configuration to allow one hand to remain free.

Figure 3:
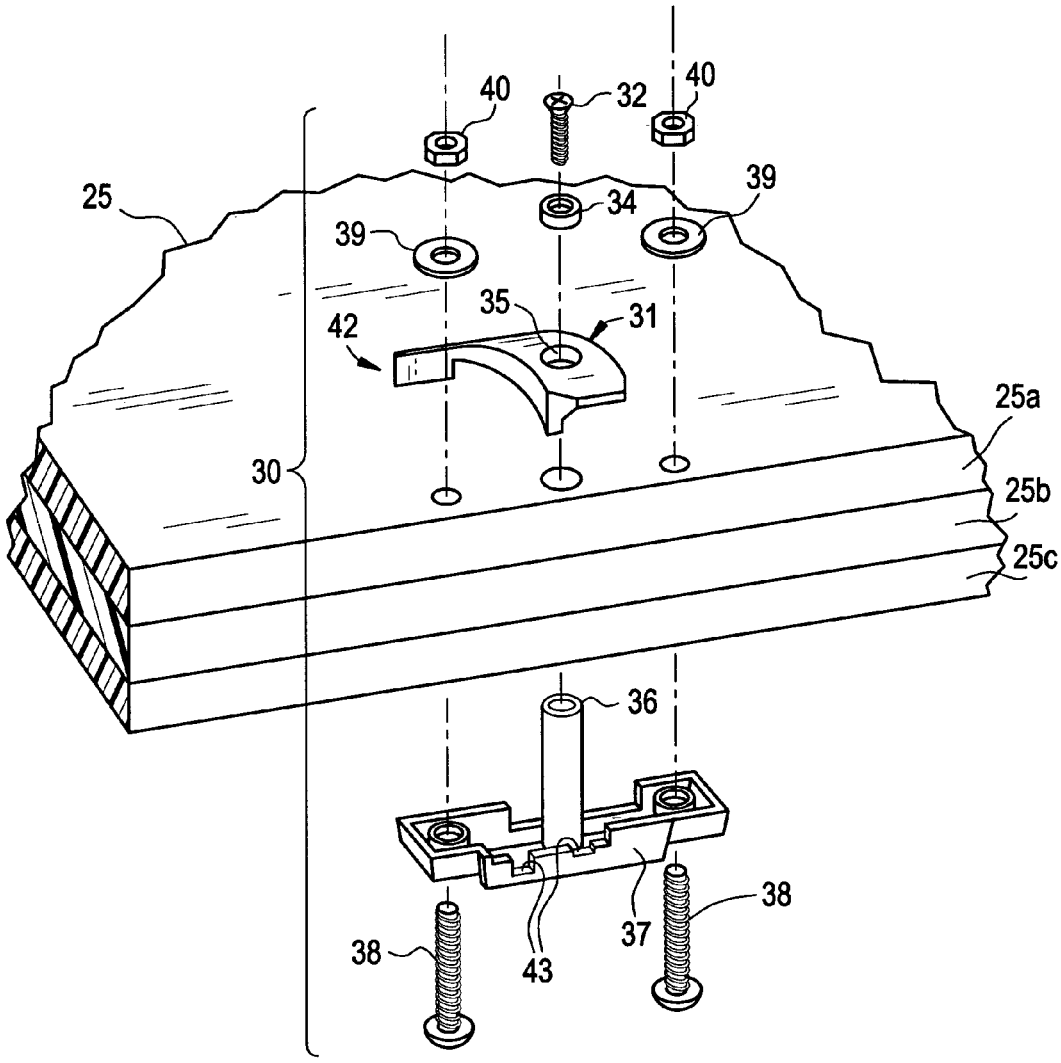
FIG. 3 is a partial cut-away exploded view of a portion of the ballistic shield illustrating engagement/disengagement mechanism that includes a cam lever.

FIG. 3 depicts a cam lever engagement/disengagement mechanism 30 for removably securing the shield 25 from a partition frame. The cam lever assembly can be mounted either on the shield or the partition frame. The cam secures the shield to the partition by engaging a corresponding located opposing slot (not shown). The forward contact point of the cam can be co-planar with the rotation plane, or alternatively the forward cam edge can be oriented at a slight angle so as to urge the shield against the partition landing edge. The cam-type mechanism is preferably mounted on the partition frame, and the opposing slot is located on the shield to keep the weight of the shield down. Cam lever 31 is retained by screw 32 placed through the borehole 35 and insert sleeve (bushing) 34 and secured to the tapped screw boss/post 36. The designated length of the boss post is governed by the total thickness of the shield panels. The cam lever mechanism 30 is secured to the shield or partition frame depending on choice, by the two screws 38, using washers 39 and nuts 40. FIG. 3 shows a partial section view of the shield panels 25-*a*, 25-*b*, and 25-*c*. When the cam lever is mounted on the partition frame, as is preferred (not shown), a slotted "L" bracket integral with the shield frame provides the opposing slot which receives the forward cam edge such as shown at 42 in FIG. 3. One embodiment partition assembly which has a relatively rigid shield frame may allow acceptable rigidity for the engaged shield using one cam lever mechanism. A preferred embodiment locates the cam lever mechanism at the top horizontal partition frame around the midpoint between the B-pillars, and a lower channel of length from 10% to 80%, preferably 30-50% of the lateral span of the lower portion of the shield, running along the lower horizontal partition member. The shield is installed by inserting the lower horizontal shield frame within the retaining channel and swinging the shield upright whereby the cam lever locates at the slot in cooperative alignment, and the cam lever forward edge such as at FIG. 3 at 41 is rotated some degree, up to about 180 degrees by grasping the cam lever grip area 42 inserting the cam forward edge into slot. Optional detents are provided within the lever housing as illustrated at 64 in FIG. 3 and are optional and preferred to provide tactile and/or auditory feedback when the cam lever is retracted in fully closed and/or fully open position. In this example the cam lever rotates 180° in a horizontal semicircular arc to advance the forward cam edge into the vertical slot (not shown). The rotating cam mechanism is preferably secured directly to the partition frame by screws, or through-bolted. The preferred partition includes a plastic- or rubber-clad soft steel or aluminum bead permanently affixed to the partition tube steel to allow a snug clearance to the shield perimeter under light compression to eliminate squeaks and rattles.

Figure 4:
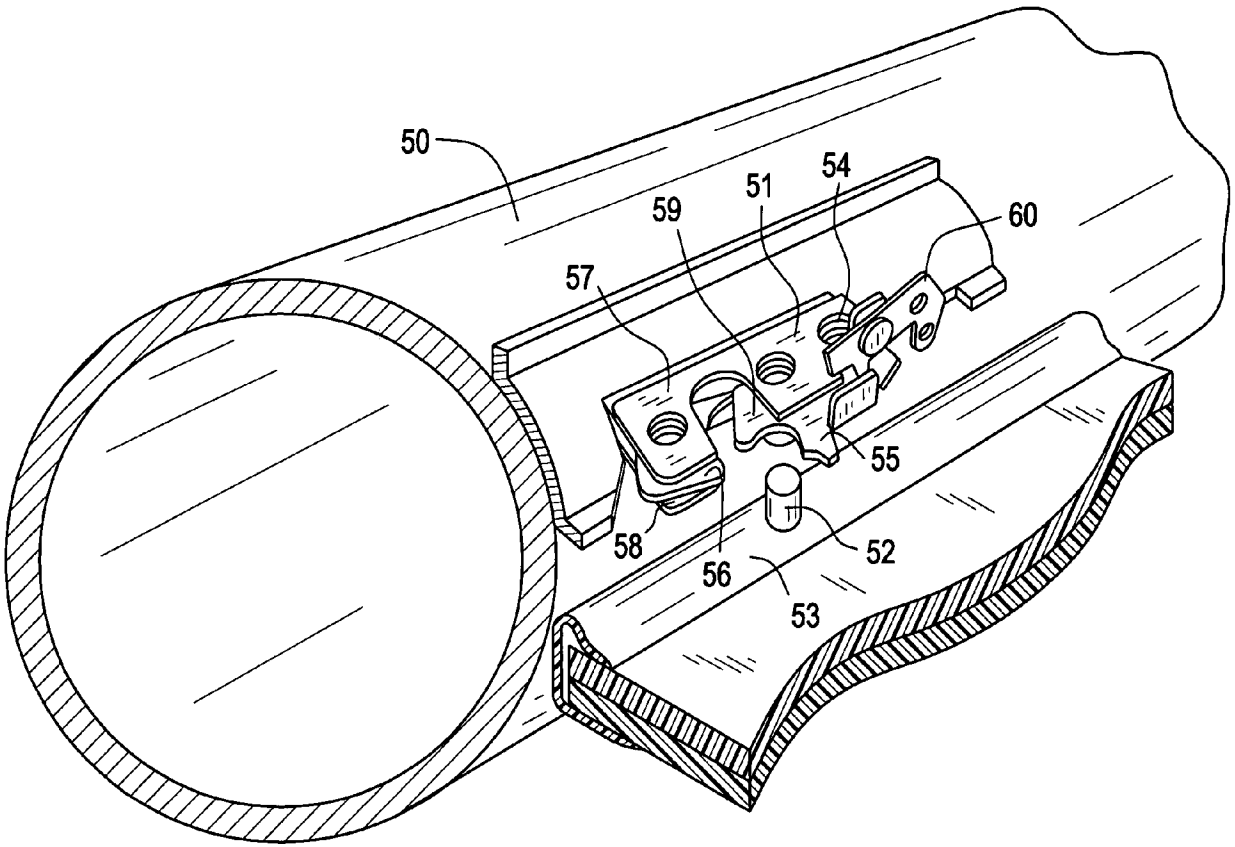
FIG. 4 is a plan view and partial cross-section view of a shield section about to be secured to an engagement/disengagement mechanism mounted on a partition frame member, the capture lever secures a pin located on the ballistic shield frame (shown).

FIG. 4 is a perspective view of another latch mechanism 51 secured to tubular steel partition frame 50. The mechanism is a shield retainer system of the rotary action-pin capture type shown partially engaged to swing out and grasp retaining pin 52. The pin is integral with the ballistic shield frame 53 (partial cut-away shown). The pin-capture latch mechanism is configured to lock pin 52 to secure the shield to the partition.

The rotary latch is well known and commonly used in the automotive industry. The rotary latches available commercially have a number of variations and features which are suitable alternatives, and are beyond the scope of this disclosure. A commercially available latch is the SLIMLINE ROTARY LATCH® from Eberhard Manufacturing Co. of Cleveland, Ohio. The quick-release rotary action-pin capture type latch includes a rotor 54, a catch 55, and a strike 56, each axially seated between two plate supports 57, 58. Each plate support 57,58 has a radial cut-out in alignment with each other and with a radial cut-out 59 formed in the catch 55. The cut-outs define an opening in the latch for receiving the pin 52. When the pin is positioned in the striker-catch opening, the catch 55 is rotated to enclose the pin 52 so as to secure the shield to the partition. The rotor 54 and the catch 55 are typically spring biased in opposite directions and configured to engage with each other in a known manner so as to keep the catch 55 in the locked position. It is also generally understood that when additional force is applied against the spring biased force of the rotor 54, the catch 55 disengages with the rotor 54 and rotates to an open, releasing position. In one embodiment, a trip lever 60 is connected to the rotor 54 and can be actuated to rotate the rotor in a direction opposite its biasing force, thus causing the rotor to release and disengage with the catch 54.

Figure 5:
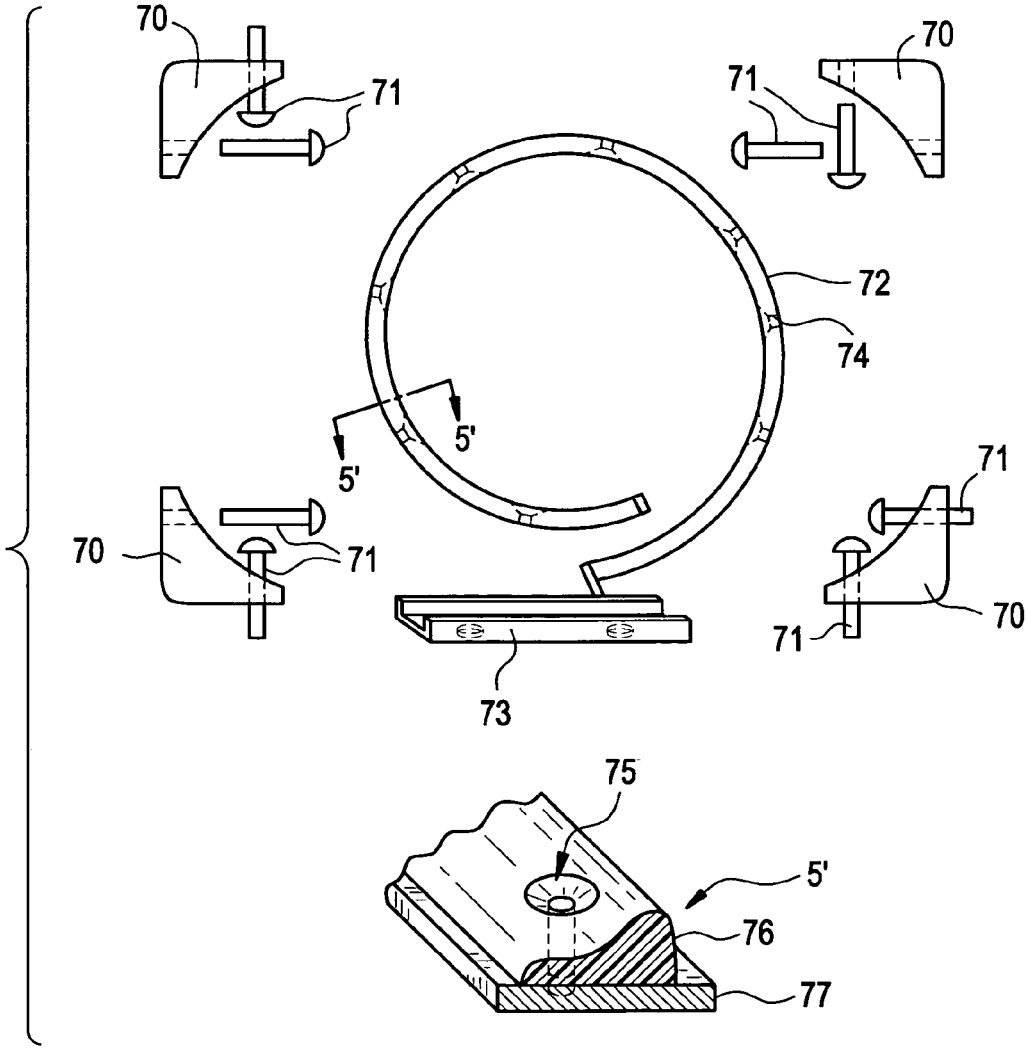
FIG. 5 is an exploded view of a partition up-fit kit including corner inserts, a channel and a partition inner frame bead.

FIG. 5 illustrates a shield up-fitting kit having components designed to be installed in partitions which are already installed in the vehicle (retro-fitting). The kit includes frame corner inserts 70 with bore through holes for using screws 71. Alternatively, through bolts can be used to bolt the corner inserts to the partition frame. A partition frame inner bead 72 is fastened by screws (not shown) at the bores 74 along its length. The bead 72 can be bent to the perimeter of the partition. Channel 74 with bore holes is used to mount to the lower portion of the partition aperture, as discussed above. Section view 5' shows preferred version of the bead 72 with a recessed bore through 75, flexible plastic or rubber bead 76, and metal base 77.

Figure 6:
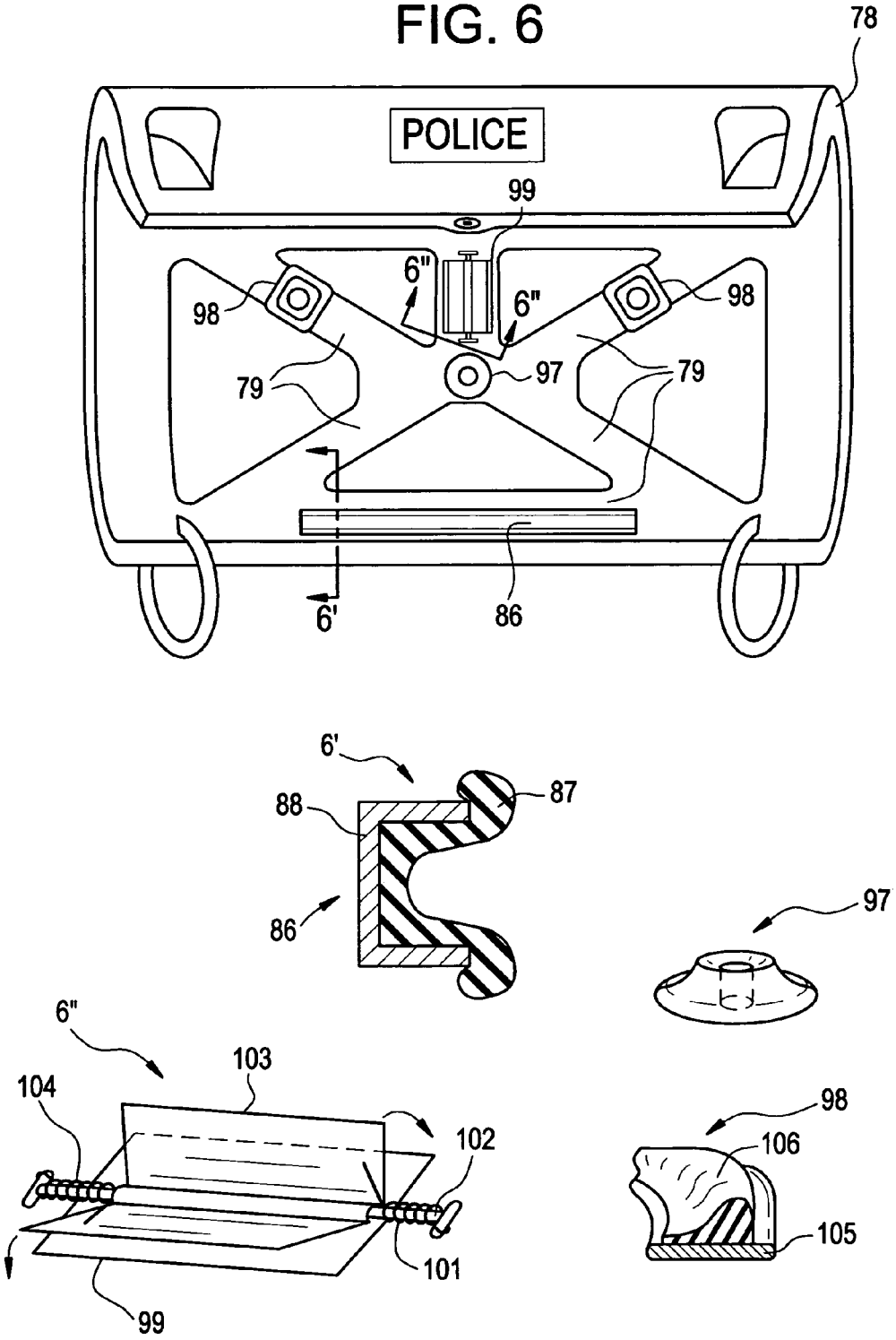
FIG. 6 is a plan view of an up-fit kit for a trunk lid illustrating contact pads, channel, and spring-hinged bracket components.

FIG. 6 illustrates a general points for locating shield holding hardware, and a few detailed embodiments. The trunk mounting kit adds a quick-release holding hardware for securing the ballistic shield to the underside of the trunk lid 78. In one embodiment (shown) the up-fit kit includes a plurality of padded contact points any or all located in spaced apart pattern aligning with the shield panel. Suitable engagement/disengagement hardware mentioned herein (not shown in FIG. 6) can also be fabricated into simple, rotating arms with spring-loaded bearing detents, a hasp, slidable pin or flat protuberance, with corresponding retainer. The components of the shield retainer system for the trunk is fastened to the structural (framing) members some of which are shown at 79 of the underside of trunk lid 78. One embodiment kit (shown) includes rubber or plastic contact pads 97, 98 secured to the lid framing members 79 by screws (not shown). Contact pads are of any shape. Pad 98 depicts a corner pad with plastic or metal base 105, and coating, rubber or plastic contact surface 106. One embodiment of channel 86 is shown in detail cross-section at view 6' and includes a rigid member (e.g. metal or plastic) 86 with a coating/rubber/or plastic-cladding 87 bonded thereto. Bonding is by co-extrusion, or adhesive, commonly available for this purpose. The rigid member can be fabricated from rigid, reinforced plastic or from a soft metal such as cold rolled steel or aluminum channel. A spring-hinged bracket 99 is shown in detail at 6" where hinge pin 102 has a surrounding spring 101 installed with spring tension on the bracket 103. The spring is retained under tension to urge the bracket 103 toward the shield and trunk lid.

The Shield includes a frame around the panel border (perimeter) to protect the panel members and add rigidity, and provide mounting surfaces for the engagement/disengagement hardware. Optionally and preferredly, a frame cross member is included to add sag-resistance. This cross-member (not shown) has a designed thickness normal to the shield plane, and can be made from metal, or preferably fiber-reinforced thermoplastic (FRP), more preferably long fiber reinforced thermoplastic (LFRT) which is molded or extruded to the suitable shape. Such LFRT compounds are available from Ticona CELSTRAN®. The Shield frame can also be a rim channel that can be bent to fit around the shield panel perimeter, and made with aluminum. In the bendable shield rim it is preferred to provide soft facing material which contacts the shield panel, to provide cushion, and stress concentration. Suitable facing materials are made from felts, foams, molded or extruded elastomer, e.g., EPDM, Viton® and silicone, or molded or extruded thermoplastic elastomers such as SBS, SEBS, p-PVC, TPU, pevaloy, or other shapeable flexible material. The shield frame may be a composite or integral frame and rim member of multiple materials, e.g., metal over-molded in the shield contact portion with any of the above mentioned cushioning/flexible materials. In one embodiment wherein elastomer shield rim material is used, the rim provides flexing, to allow for some compression when securing the shield to the frame aperture dampening sock, eliminating vibration, rattling or squeaks when the shield is fastened to the aperture frame. An over-molded metallic strip may provide both rigidity and a compressible surface. A rim is preferred for additional durability without adding to the overall shield weight significantly. Also, a molded shield rim may house an integral handle or handles. The shield rim is preferably attached to the edge of the shield by adhesive. Other attachment techniques include riveting, bolts, compression, clamping, and/or a combination of methods to securely fasten the shield rim to the perimeter edge of the shield.

The shield rim member (shield frame) preferably has integral shield handles, as protuberances for grasping for removable engagement with the shield frame, and for holding the shield while carrying and assuming a protective stance. Referring to a rim member with handles, the handles may be formed integrally, by molding, insert-molding, casting, and for non-integral handles. These handles may be attached to the rim member by conventional bolts, rivets, adhesive, welding, or a combination of fastening components or bonding methods. The handles in general, be they part of the perimeter rim member or otherwise are placed so they protrude toward the front seat compartment since the rim comprising one or more handles will protection of the edges.

Polymer materials selected for forming bullet-resistant panels are widely available commercially from distributors of plastic sheets and rods. In one embodiment, the shield is formed from transparent layer of plastic or laminate of more than one plastic layer. In an alternative shield embodiment, the transparent plastic makes up a portion, for example about 50% of the total shield area. In a preferred alternative, the shield is rectangular and contains two different materials, where one half is transparent, and the other half is non-transparent. The portion of the alternative embodiment shield area which is not transparent is advantageously the lower portion of the shield with the boundary along the long axis, such that when the shield is attached to the vehicle partition, the non-transparent portion is in the lower half and the transparent portion is in the upper half of the shield, allowing the driver to see through, and continue use of the rearview mirror. The non-transparent portion of the alternative shield can be fabricated from variety of bullet-resisting material, such as steel sheeting, or a laminated fabric made of multiple KEVLAR fabric layers forming a more bullet penetration-resistant portion of the shield as compared to a transparent plastic portion which is integrally bonded to the more bullet-resisting portion. The fabric portion of the shield may be reinforced with layer of bonded glass fiber, such as provided by u-PET resin used for spray up-lay-up construction. A shield frame can be employed to add rigidity. A shield frame can be an aluminum channel formed around edges of the shield panel, for example using 0.156 inch thick aluminum stock.

The degree of bullet resistance in the shield is a matter of design selection taking into account the ultimate weight of the shield according to market requirements and is beyond the scope of this disclosure and the known materials and construction examples provided herein.

The preferred shield embodiment is a transparent, multi-layered laminate of impact resistant polycarbonate and/or acrylic bonded by a tough urethane adhesive elastomer. One preferred embodiment shield panel is made of three layers of polycarbonate with security film laminated on one side, which is the side facing the carrier of the shield. Security films prevent shards from becoming projectiles and have toughness and tear-resistance and good adhesive properties. Impact resistant and/or shatterproof. The preferred type of security film comprises multiple layers of polyester. A variety of polyester security film embodiments are illustrated in U.S. Pat. No. 3,899,621. Suitable film for the present use includes three and five layer films comprising layers of polyesters and polyurethanes. Preferably, the polyester layers range in thickness from 0.5 to 5 mils and the polyurethane layers range in thickness from 0.2 to 0.4 mil. Other highly suitable embodiment security films include three layers (e.g., two outer layers selected from ethylene/vinyl acetate copolymer, an ethylene/vinyl acetate/triallyl isocyanurate terpolymer, a polybutyl butyryl, a polyvinylformal, or a polyurethane), and a layer between the outer layers selected from polyethylene terephthalate, polyamides, polyester polyethers, polysulfones or polyimides. A tinted version can be made by substituting one layer with vapor-deposited aluminum polyethylene terephthalate the selection of the type of security film is a matter of the designer's preference, and these products are widely distributed by many suppliers of safety and security film, such as Clear Defense Incorporated, 121 E. Main St., Martinsville, Va.

If the design choice is to provide relatively more bullet resistance, the transparent plastic-sheet based shield panel embodiments can consist of three sheets, or more. Each sheet layer is from 0.2-0.4 inches thick and held together by the shield frame. Alternatively, the layers can be spaced apart by a predetermined distance up to about 1-2 cm. A wide aperture adhesive scrim or hot-melt-applied spacers can be added at spaced-apart patterns can be placed between the spaced layers. One or more intervening security films can be used and one security film on the exterior side having handles.

The laminate employed for the shield can be formed from the aforementioned commercially available impact-resistant thermoplastic and/or thermoset resins. Conventional methods of forming the shield include application of the interlaminar adhesive, assembly and compression molding the individual sheet layers. Typically the shaped layered assembly is removed and the edges finished by trimming, grinding and/or cutting. Some excess flash may need to be removed where the compression mold cavity is machined to provide the final shield dimensions. The compression dies can include a cutting die defining the perimeter shape which under hydraulic press is forced through the plastic laminate sheet, preferably brought to an elevated temperature above the glass transition temperature of the layer materials. Such sheet would be placed in the compression dies while in a heated, softened state to facilitate the die cutting without further cutting or grinding to provide a desired dimension. Latch receptacles which are through holes which accept protruding latch pins can be made by pressing a metal punch or dowel which has been heated above the melting point of the plastic. Thoughtless which are molded into the shield panels preferably are fitted with rubber or soft TPU grommet to protect the edges of the holes.

The overall shape of the shield can have a pre-designed convexity, imparted by machining the cavity of the compression mold to a curve of a predetermined radius of curvature. The preferred shield is planar or has a radius of curvature of more than about 8 feet. Shield layers can be laminated by applying curable adhesive, or less preferred are clamps, bolts, riveting.

Another embodiment shield utilizes a perimeter frame which supports a section employing ballistic polymer panels such as made from Kevlar, including one or more apertures for viewing or aiming a fire arm there through. For example, there may be two spaced-apart apertures, one of the apertures may be an open void and the other covered by a planar section of impact-resistant transparent thermoplastic or laminate, with its perimeter conforming to or overlying the edges of the aperture and fixed to the shield to overly the aperture.

Referring to FIG. 1 in one embodiment shield 100 includes body 100, window 115, top cap 120, legs 130, a pair of side arms consisting of aft side arm 140 and forward side arm 150, and side shield 160. Security shield 100 is constructed to substantially fill the space behind the front seat of vehicle 10 in lateral dimension and from a position below the knee level to the ceiling, as illustrated in FIG. 1, legs 130 rest on respective lateral frame members 40 holding the security shield 100 with top cap 120 firmly pressed against the ceiling of vehicle 10. Each leg 130 is attached to a corresponding door pillar 20 for lateral support via the side arm consisting of aft side arm 140 and forward side arm 150. The transparent side shield 160 provides additional security at the sides of security shield 100. The shield body 110, when installed, substantially fills the space behind the front seat of vehicle 10.

EXAMPLES

The bullet resistance of the following shields were tested by firing rounds of .22, .38, 9 mm, .357, and .45 caliber from pistols while standing at a distance of 30 feet from the shield.

Example 1

A tri-layered shield measuring 9.5×20.5 inches was constructed by plying three layers together, (1) 0.25 inch thick polycarbonate sheet (Lexan®, product of General Electric), (2) 0.375 inch thick polycarbonate sheet (Lexan®) and a 0.020 inch thick (20 mil) security film (available from General Rubber, Inc. Foundation Drive, Florence, Ky. Pistol rounds were fired at the polycarbonate side.

Example 2

A tri-layer shield was constructed of three polycarbonate sheet layers, each measuring 0.25 inches in thickness. The three sheets were plied together and bonded at the perimeter with RTV silicone sealant. The three-layer example 2 stopped rounds of .22, .38, 9 mm, .357, .45 caliber and Hydra-shock rounds from pistols. The bullet impacts caused some separation of RTV silicone at the top of the shield, and the bottom portion remained intact. The .45 caliber rounds penetrated the furthest, going through the second layer and denting the third piece of Lexan® polycarbonate but did not pass through the third layer.

In light of Example 2, a shield of similar construction and shaped similarly to the shield 10 shown in FIG. 1, and bonded at the perimeter with RTV silicone including a plastic edge-molding, and including two handles and latch components affixed to the shield is expected to provide useful shielding properties.

In accordance with the invention and in view of the foregoing description, other embodiments can readily be constructed to optimally pass one or more UL®-752 standards for bullet resistant materials, against bullets having calibers of .38, 9 mm, .40, and .357 magnum with a bullet grain of 110 or 158 from a distance of 30 feet.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and description. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention described in the specification are intended to be encompassed by the present invention.

I claim:

1. Vehicle interior security partition apparatus comprising a frame with upper frame members and lower frame members, the lower frame members have attachment members for mounting to the floor and the upper frame members have attachment members for mounting to the roof or B-pillars, the mounted frame members provide structural rigidity independent of the front seat, a shield engagement/disengagement mechanism mounted on said frame, and a detachable, hand-carry, ballistic shield removably mounted to said frame, the ballistic shield comprising a ballistic shield portion, peripheral edge member surrounding the shield portion, a handle, and a shield securing component;

said ballistic shield portion consists of two overlaid ballistic panels each having approximately the same outer perimeter shape, each constructed of a rigid, transparent polycarbonate, and secured together by the peripheral edge member, wherein the shield securing component is mounted on the edge member and the shield is held in said frame by engaging the securing component to the engagement/disengagement mechanism on the partition frame.

2. The apparatus according to claim 1 wherein said ballistic shield further consists of a third overlaid transparent layer.

3. The apparatus according to claim 1 wherein the shield engagement/disengagement mechanism is located in said upper portion of said partition.

4. The apparatus according to claim 1 wherein the shield engagement/disengagement mechanism is located in said lower portion of said partition.

5. Vehicle interior security partition apparatus comprising a frame with upper frame members and lower frame members, the lower frame members have attachment members for mounting to the floor and the upper frame members have attachment members for mounting to the roof or B-pillars, the frame members provide structural rigidity independent of the front seat, a shield engagement/disengagement mechanism mounted on said frame, and a detachable, hand-carry, ballistic shield removably mounted to said frame, the ballistic shield comprising a ballistic shield portion, peripheral edge member surrounding the shield portion, a handle, and a shield securing component;

said shield securing component is one component of a two-component engagement mechanism which engages to the complementary component of the engagement/disengagement mechanism mounted on the frame of the interior vehicle security partition.

* * * * *